US005516235A

United States Patent [19]

Stangroom

[11] Patent Number: 5,516,235

[45] Date of Patent: May 14, 1996

[54] METHOD AND APPARATUS OF RAISING OBJECTS FROM THE SEA BED

[75] Inventor: James E. Stangroom, Bradwell, England

[73] Assignee: Controlled Lifting International Limited, Sheffield, England

[21] Appl. No.: 367,275

[22] Filed: Jan. 11, 1995

[51] Int. Cl.[6] ..... B63C 7/10

[52] U.S. Cl. ..... 405/188; 114/50; 114/52

[58] Field of Search ..... 405/171, 188; 114/50, 52, 53, 54, 312, 315

[56] References Cited

U.S. PATENT DOCUMENTS

| | | | |
|---|---|---|---|
| 1,373,643 | 4/1921 | Ariura | 114/52 |
| 3,090,976 | 5/1963 | Liu | 114/54 X |
| 3,702,597 | 11/1972 | Odum et al. | 405/188 |
| 4,078,509 | 3/1978 | Buecher et al. | 114/54 |

FOREIGN PATENT DOCUMENTS

| | | | |
|---|---|---|---|
| 584154 | 9/1959 | Canada | 114/54 |
| 618836 | 2/1949 | United Kingdom | 114/54 |

*Primary Examiner*—David J. Bagnell

*Attorney, Agent, or Firm*—Trexler, Bushnell, Giangiorgi & Blackstone, Ltd.

[57] ABSTRACT

A flexible envelope, of fabric, plastic sheet or similar material, is made buoyant by being filled with water of lower salinity than the surrounding medium, and used to lift loads underwater. The lift can be generated in situ by pumping water into the envelope after it has been attached to the load through a hose form the surface, and reduced by either releasing the water from within the envelope or pumping it back to the surface again. By combining these two operations, the lift can be exactly controlled. Several envelopes can be used to lift a single load, and the load itself can be made up of small objects placed in a suitable container by other means. The envelopes may be towed into position, or may be provided with their own means of propulsion.

24 Claims, 1 Drawing Sheet

METHOD AND APPARATUS OF RAISING OBJECTS FROM THE SEA BED

BACKGROUND OF THE INVENTION

Two methods are commonly used to raise large objects, such as sunken ships, from the sea bed. Firstly, the object may be lifted directly with cables and a crane mounted on a suitable vessel. This is open to many objections. For very heavy objects, a large and very costly lifting vessel must be employed. The cables may tangle if more than one is needed to sustain the weight. At very great depths, the weight of the steel cables is a significant part of the total load. Steel cables have little compliance, and so will transmit wave movements directly to the load, considerably increasing peak stress. These last two problems can be overcome by using cables made of synthetic fibre with approximately the same density as water. However, these are costly, and, if they break, the large amount of stored energy can cause serious accidents.

The second lifting method employs air-bags. A balloon is attached to the load, and air is pumped into it, generating lift equivalent to the water displaced. A variation of this is the close all the apertures on a wreck, and fill it with air; the wreck itself then acts as its own balloon. Although it is simple and relatively cheap, this method suffers from being virtually uncontrollable. Normally, extra lift, over and above the weight in water, is required to break the object free from the bottom. Once the load starts to move upward, the air in the balloon expands, further increasing the lift. The rate of ascent therefore increases, until the load virtually leaps out at the surface. Since the air-bag usually has an open bottom, the air is often spilled at the surface, so the load descends to the bottom again.

There are other problems at very great depths. The air must be pumped down from the surface at a pressure at least equal to that at the sea bed; hence, powerful pumps and very heavy pressure hose must be used. Furthermore, the solubility of a gas is proportional to its partial pressure (Henry's Law), so a considerable proportion of the air actually supplied will be lost by dissolving in the sea-water.

The system proposed seeks to combine the simplicity and cheapness of the air-bag system with the excellent control of the direct lift method.

SUMMARY OF THE INVENTION

The technique proposed is equivalent to the air-bag method, with the crucial difference that the air is replaced by fresh water. Depending upon salinity, sea water is roughly 2% more dense than fresh water; hence, a bag containing 1 cu.m of fresh water will experience a lift of approximately 20 kg. Since the compressibility of the two fluids will be identical, this lift will be independent of depth, and will not increase as the load rises. This principle has been applied, in a slightly different form, in the "Bathyscaphe", with buoyancy provided by a large volume of oil. However, it would clearly be impractical, on both pollution and economic grounds, to pump large amounts of oil in the sea where there is, inevitably, a risk of leakage. A leak of fresh water, on the other hand, is unlikely to have any serious consequences.

The surface pressure required to pump water down to the "balloon" will be 2% of the pressure at the latter. For example, the pressure at 2000 m. depth in sea-water is roughly 200 Bar, say 3000 p.s.i., but the static pressure required to pump fresh water down will be only 4 Bar, say 60 p.s.i. This low pressure will allow wide, thin-walled hoses, such as standard fire-hoses, to be used. Since the stresses will be relatively low, a wide variety of materials can be used to construct these hoses; it would clearly be useful to arrange that the net specific gravity of the hose full of fresh water was roughly unity, so that the hose was supported by the water, and therefore not subjected to tensile stress.

A balloon filled with fresh water will need to be roughly fifty times the volume of an air-bag to provide the same lifting force. Quite large volumes of water will be required —for example, to generate 5000 tonnes lift, approximately 250000 tonnes of fresh water will be required, equivalent to a 78 m diameter sphere, although in practice the water would probably be distributed between several smaller bags. However, this is not a serious difficulty. Fresh water is cheap and can be carried to the salvage site either in tankers or in "Dracones"; indeed, many ships distil several tonnes of fresh water per day, which may well be enough for modest lifts. Using the latter, virtually all operations could be carded out using quite small, conventional vessels, as against the costly lifting barges used for conventional salvage with cables. Hence, this technique could have considerable economic advantages.

CONSTRUCTION

The stresses in the water-filled balloon will be low, so that very light material, such as thin plastic sheet, can be used. The actual balloon itself would resemble a hot-air balloon and would be designed by the same general methods. For light loads, the fabric itself could sustain the stress, but for heavy loads, the best method would be to reinforce the seams between the gores with suitable rope or tape. This method, which is well known in hot air balloons, gives the possibility of minimising the stresses in the fabric by allowing it to bulge out between the seams—it is generally accepted that the local stresses in such a structure fall with the local radius of curvature. Another method of transmitting the load to the fabric envelope is to use a net over the top of the balloon; however, this might increase the danger of tangling underwater. The supply hose would be connected to the top of the balloon; the bottom could be either open, as in a hot-air balloon, or closed, although an over-pressure valve would be required.

DYNAMIC BEHAVIOUR AND CONTROL

The large volume of the balloon has a significant advantage, in that it will act as a very effective damper, and will slow down the ascent. The mass of the fresh water will also contribute to the control. The "extra" lift, over and above the weight of the object, required to detach the latter from the sea-bed is often considerable, and with air-bags, or cables, which have little mass in themselves, this excess lift will cause the object to accelerate once it has broken free. With the method proposed, however, the excess lift must accelerate not only the object itself but also the mass of the fresh water. These two features will ensure that the object ascends steadily.

The steady, highly damped movement of the balloon and its load offers ideal conditions for buoyancy control by pumping water into and out of the envelope. Pumping water in from the surface presents few problems, but removing water by the same method would inevitably be slow. Although the static pressure required to drive the water down is low, the resistance of, say, 2 km of hose would be considerable, so the hose should be as wide as practicable.

This presents no difficulties if the tube is made of wide, flexible material, but such a tube will collapse if the pressure inside falls at all below the pressure outside, so the only pressure available to drive fresh water to the surface will be that due to hydrostatic heads. This problem can be overcome in several ways. The fresh water in the bag can be diluted and displaced by sea water pumped down from the surface, either through the primary hose, or a second one. The fresh water can be released by a valve at the top of the balloon, controlled from the surface:—the pressure differential between the top and bottom of the latter will drive it out. These methods waste the fresh water. This could be avoided by a pump attached to the balloon controlled from the surface to assist in returning the water to the surface. All the control methods relying on pumping water to or from the surface will be relatively slow, since they will be limited by the inertia of the water in the hose. For fine control, it will probably be necessary to provide remotely controlled dump valves at the bottom end of the pipes, so the flow can be diverted away from the balloon quickly even if it cannot be stopped. With these precautions, it should be possible to "hover" the balloon and its load at any desired depth if required, for example to avoid wave action on the surface. Similarly, the balloon system will allow objects to be lowered, as well as raised, under complete control. It is often required to place pumps, etc. on underwater platforms, no mean task with cables from the surface; the balloon system would completely isolate the load from wave action, etc., and allow it to be lowered under complete control.

Unlike normal lifting with cables, the technique proposed does not require the surface vessel to be exactly positioned with respect to the load. This is a considerable advantage, since keeping a conventional salvage vessel exactly on station normally requires either multiple anchors or precise navigation by satellite. Indeed, if buoyancy control was not required, all connection between the salvage vessel and the load could be severed once the load had started to lift, providing the water connection to the balloon had a non-return valve: the ascent could be followed by a transponder on the balloon. However, this loose connection makes it difficult to get the balloon to a precise point on the sea bottom. It would therefore be necessary to tow the deflated balloon (which could be packed in a suitable container if necessary to reduce drag) to the load on the bottom with a suitably modified ROV (Remotely Operated Vehicle) during the descent. In the limit, for work in strong currents, the balloon could be streamlined, like a conventional airship, and provided with its own propulsion motors.

In very great depths of water, the time taken for the balloon to ascend and descend could be a significant disadvantage, particularly if a large number of small objects are to be recovered. In this case, the balloon could be attached to a suitable carder, which was loaded by one or more ROV's.

FINAL RECOVERY

Like the conventional air-bag system, this technique will not allow the recovered object to be lifted on board another vessel; cranes, or similar devices will be necessary. However, it would be possible to tow the object, suspended below the surface to avoid wave turbulence, to shallow water or to a shore-based lifting facility. Other final recovery techniques, such as "Camels" or semi-submersible barges, could also be used. Once the load was on the surface, it would also be possible to replace some or all of the fresh water with compressed air, which would lift the load much closer to the surface.

DETAILED DESCRIPTION OF THE DRAWINGS

Figure 1:
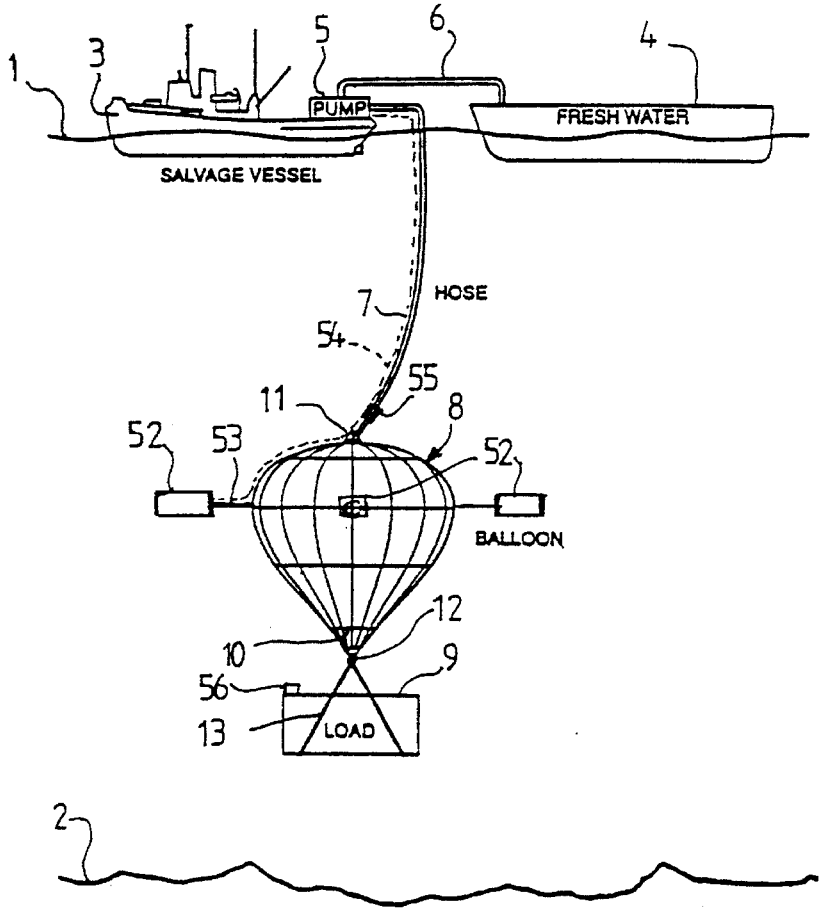
FIG. 1 shows diagrammatically the basic principle of the method and apparatus in accordance with the invention.

In FIG. 1, the sea surface is indicated at 1, the sea bed at 2, a salvage vessel at 3 and a fresh water supply barge or tanker at 4. The vessel 3 is provided with at least one conventional, centrifugal water pump 5, with a fresh water supply hose 6 connected to the tanker 4, and a fresh water delivery hose 7 extending to balloon 8 (one only illustrated), connected to a load 9 to be lifted or lowered.

The balloon 8 has a permanently open bottom 10, (in much the same manner as a conventional hot-air balloon), an upper fitting 11 and a lower fitting 12 from which slings 13 extend to the load 9.

The low hydrostatic pressure enables standard hoses 6 and 7 to be used, e.g. of the "lay flat" plastic kind. The selected diameter for the or each hose depends on the volume of fresh water required to be pumped, the capacity of the pump(s) 5 etc. Typically, 6 inch (150 mm) plastics hose in 275 yard (300 m) lengths is suitable, with a metal fitting at the joints.

Figure 2:
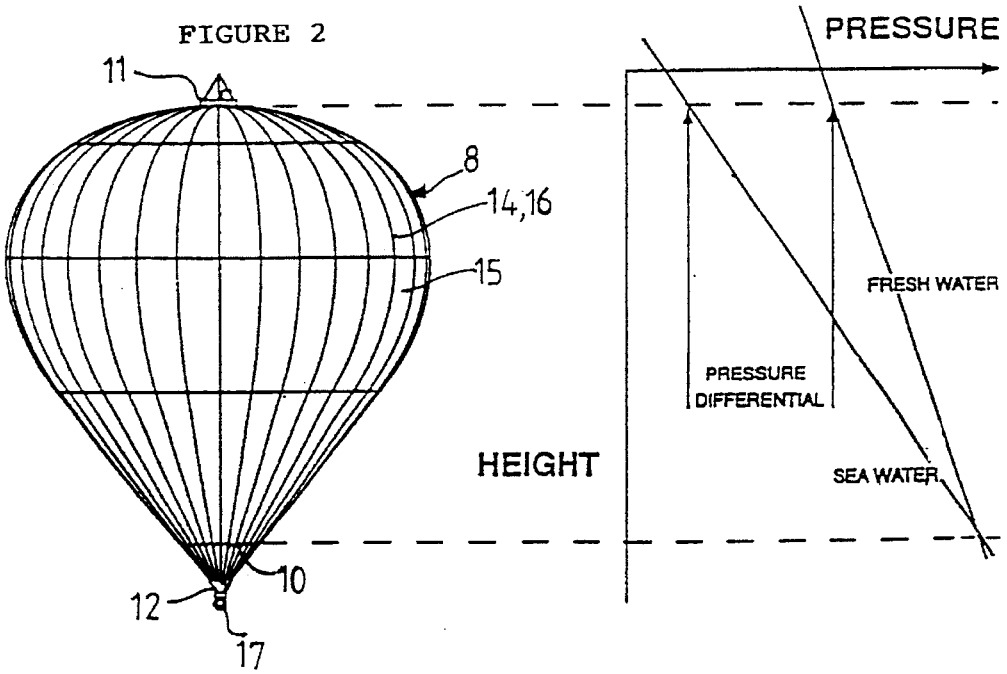
FIG. 2 shows the pressure drop across the balloon.

Considering FIG. 2, the pressure difference across the balloon 8 increases linearly from zero at the open bottom 10. Above this point, the pressures of both the sea—and the fresh water diminish, but the former decreases more rapidly so there is a steadily increasing pressure difference across the balloon 8. If the pressure difference across the balloon 8 at all points is known, standard computer programmes are available to optimise the detailed design of any balloon, regardless of the media involved.

Since the pressure difference at the top of a balloon is proportional to the density difference, the fabric at the top of a "water" balloon need resist no more than 2% of pressure at the top of a known air-lift bag of equivalent depth. This has three important consequences:

1. a "fresh water" balloon can be made of ordinary light material such as rip-stop Nylon. Providing they are closely woven, fabrics need not be coated, since the effects of diffusion, osmosis, etc, are negligible. By contrast, known air-lift bags for salvage use must be made of strong rubberised fabric which is heavy, stiff and difficult to handle.
2. fresh-water balloons are virtually unaffected by minor leaks. This is due not only to the low pressure but also to the high viscosity and density of water compared with air, which means it will flow through a hole much more slowly. The low internal pressure also make it relatively easy to repair minor damage to a fresh-water balloon.
3. fresh-water balloons can be made much larger, and can lift much greater loads, then salvage air-lift bags, even though the latter will exert much more lift per unit volume.

In connection with this last point, it is well known that the stress on a material resisting a given pressure decreases as the radius of curvature is reduced. This is often exploited in the design of balloons, by allowing the gores (the strips of fabric making up the balloon) to bulge out between the seams, thus decreasing the local radius of curvature. However, this principle is difficult to apply at the top of a balloon or air-lift bag, so, for the same internal pressure, larger balloons must be made of stronger fabrics. Having a relatively large internal pressure, an air-lift bag must be made of very strong fabrics, but, even so, there is a limit to the maximum allowable radius of curvature. As a result, air-lift bags are limited to loads of about 50 tonnes. Water balloons, with their much lower internal pressures, are not so severely limited and so can be made much larger.

The construction of the water balloon is very similar to that of a hot-air balloon, but reinforcements must be added at key points, since the lift of a fresh-water balloon is 40 times greater than that of the equivalent hot-air balloon. The low lifting pressure over the whole area of the balloon must be transferred to the load. Thus, as indicated in FIGS. 3 to 5, seams 14 between the gores 15 of the balloon are reinforced with heavy Nylon webbing tapes 16, which extend beyond the bottom 10 of the balloon to a lifting point in the form of an eye bolt 17.

In order to supply fresh water to the interior of the balloon 8, the latter is provided with an inlet aperture to which the delivery hose 7 is connected.

As indicated in FIG. 1, manoeuvering of the balloon 8, e.g. to counter a current or for accurate emplacement of a load 9, may be effected by remotely controlled means of propulsion, such as four ROV's 52 connected by ropes or hies 53 to the balloon 8, with power and/or telemetry leads 54 clipped to the hose 7 in which a non-return valve is indicated diagrammatically ah 55. A transponder 56 is attached ho the load for station keeping of the salvage vessel 3.

I claim:

1. A method of controlling the buoyancy of an object submerged in saline water comprising the use of, at least one flexible envelope, attached or attachable to the object, characterized by submerging said envelope in said saline water and filling said envelope with water of lower salinity than said saline water surrounding said envelope, and thereby rendering said envelope buoyant and capable of lifting the object, lowering the object or hovering the object at a prescribed depth.

2. A method, as in claim 1, characterized in that the envelope is reinforced with ropes or tapes to spread the weight of the object.

3. A method, as in claim 1 or claim 2, further comprising spreading a load distribution net over said envelope.

4. A method, as in claim 1 or claim 2, characterized in that said envelope has a bottom open to said saline water.

5. A method, as in claim 1 or claim 2, characterized in that said envelope is equipped with a valve to release internal water pressure in the envelope(s).

6. A method, as in claim 1 or claim 2, characterized in that the lower salinity water is pumped into said envelope through a hose from the surface of said saline water.

7. A method, as in claim 6, characterized in that the hose is provided with a non-return valve.

8. A method, as in claim 1 or claim 2, characterized in that the lower salinity water within said envelope is displaceable by pumping surrounding liquid medium into it.

9. A method, as in, claim 1 or claim 2 characterized in that the lower salinity water within said envelope is releasable by at least one remotely controlled valve to control the buoyancy.

10. A method, as in, claim 1 or claim 2 characterized in that said envelope is provided with at least one remotely controlled pump to assist in the addition or removal of lower salinity water, sea-water, or a mix of lower salinity water and sea-water.

11. A method, as in, claim 1 or claim 2 characterized in that said envelope is provided with remotely controlled means of propulsion.

12. A method, as in, claim 1 or claim 2 characterized in that said envelope is used to lift, lower or hover a suitable receptacle, which is itself loaded or unloaded by other means with an object(s) to be lifted, lowered or hovered.

13. A method, as in claim 1 or claim 2, characterized by replacing the water within said envelope wholly or partly with air when the submerged object reaches the surface of said saline water.

14. Apparatus for controlling the buoyancy of an object submerged in saline water comprising at least one flexible envelope submersible in said saline water and attachable to an underwater object and provided at what, in use, is an upper end thereof, with an inlet aperture for introducing into said envelope water of lower salinity than said saline water.

15. Apparatus as claimed in claim 14, wherein said at least one envelope is basically a commercially available hot-air balloon.

16. Apparatus as claimed in claim 15, wherein said at least one balloon is reinforced with webbing tapes to spread the weight of the object.

17. Apparatus as claimed in claim 15, wherein a plurality of webbing tapes are provided extending from top to bottom around the periphery of said at least one balloon.

18. Apparatus as claimed in claim 15, wherein a transponder is provided on said balloon.

19. Apparatus as claimed in claim 15, wherein a fresh water release valve is provided at the top of said balloon.

20. Apparatus as claimed in claim 14, provided with a remotely controllable dump valve.

21. Apparatus as claim in claim 14, comprising (i) a lower salinity water pump, and (ii) a hose exuding from the pump to an inlet aperture of the envelope.

22. Apparatus as claimed in claim 21, wherein said at least one envelope is provided with a local and hence submergible water pump remotely controllable from the surface of said saline water with telemetry and/or power leads to the surface.

23. Apparatus as claimed in claim 21, wherein said hose is provided with a non-return valve.

24. Apparatus as claimed in claim 21, wherein said at least one envelope is provided with at least one remotely controllable means of propulsion, with telemetry and/or power leads to the surface.

* * * * *